US008150302B2

(12) United States Patent
Kitao

(10) Patent No.: US 8,150,302 B2
(45) Date of Patent: Apr. 3, 2012

(54) IMAGE FORMING APPARATUS AND IMAGE FORMING METHOD THAT DETECTS AN AMOUNT OF COLOR MISALIGNMENT USING REFLECTED LIGHT

(75) Inventor: Katsuyuki Kitao, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 1009 days.

(21) Appl. No.: 12/111,384

(22) Filed: Apr. 29, 2008

(65) Prior Publication Data

US 2008/0273903 A1 Nov. 6, 2008

(30) Foreign Application Priority Data

May 1, 2007 (JP) ..... 2007-121140
Mar. 18, 2008 (JP) ..... 2008-068983

(51) Int. Cl.
*G03G 15/01* (2006.01)

(52) U.S. Cl. ..... 399/301

(58) Field of Classification Search ..... 399/49, 399/66, 74, 301, 302, 303; 347/116
See application file for complete search history.

(56) References Cited

U.S. PATENT DOCUMENTS 5,995,777 A * 11/1999 Nagamochi et al. ..... 399/49
6,148,168 A 11/2000 Hirai et al.
6,285,849 B1 * 9/2001 Shimada et al. ..... 399/301
6,300,968 B1 * 10/2001 Kerxhalli et al. ..... 347/116
6,408,156 B1 6/2002 Miyazaki et al.
7,360,886 B2 4/2008 Kitao
7,379,683 B2 * 5/2008 Kamiya et al. ..... 399/49
7,702,268 B2 * 4/2010 Suzuki ..... 399/301
2006/0164506 A1 7/2006 Kitao
2006/0170754 A1 8/2006 Kitao
2007/0053024 A1 3/2007 Kitao

FOREIGN PATENT DOCUMENTS

JP 9-197752 7/1997
JP 3266849 1/2002
JP 2003-228216 8/2003
JP 2004-38013 2/2004
JP 3518825 2/2004

* cited by examiner

*Primary Examiner* — Robert Beatty

(74) *Attorney, Agent, or Firm* — Oblon, Spivak, McClelland, Maier & Neustadt, L.L.P.

(57) ABSTRACT

A pattern forming unit forms a color-misalignment detection pattern on an image carrier. A light-intensity detecting unit detects the color-misalignment detection pattern formed on the image carrier by irradiating the image carrier with a light and detecting light intensity of a reflected light from the image carrier. A color-misalignment-amount detecting unit detects an amount of a color misalignment of an image based on the light intensity of the reflected light detected by the light-intensity detecting unit. A spot of the light on the image carrier is elongated in a main-scanning direction.

16 Claims, 9 Drawing Sheets

IMAGE FORMING APPARATUS AND IMAGE FORMING METHOD THAT DETECTS AN AMOUNT OF COLOR MISALIGNMENT USING REFLECTED LIGHT

CROSS-REFERENCE TO RELATED APPLICATIONS

The present application claims priority to and incorporates by reference the entire contents of Japanese priority documents 2007-121140 filed in Japan on May 1, 2007 and 2008-068983 filed in Japan on Mar. 18, 2008.

BACKGROUND OF THE INVENTION

1. Field of the Invention

The present invention relates to an image forming apparatus and an image forming method.

2. Description of the Related Art

A color drifting often occurs in a full color image formed by superimposing images in magenta, cyan, yellow, and black by a color image forming apparatus, degrading image quality of the full color image. Specifically, the color drifting occurs more often if a write optical system and an image carrier are arranged with respect to each color and images in different colors are thereby formed by different optical systems and image carriers like in a four-drum tandem type image forming apparatus. To correct the color drifting, a position-misalignment detection pattern is generally formed on a transfer belt with a sensor to read the position-misalignment detection pattern to detect the amount of a position (color) misalignment of different color images, and the position misalignment is corrected by adjusting a write timing or by using an optical-system correcting unit.

An image forming apparatus for correcting the color misalignment is disclosed in, for example, Japanese Patent Application Laid-Open No. 2003-228216. Specifically, the image forming apparatus includes a plurality of image forming units having image carriers to form toner images, a conveying unit that conveys a recording medium along with the image forming units, a transferring unit that sequentially transfers the toner images onto the recording medium, and a detecting unit that detects position information on the image transferred by the transferring unit. With this configuration, position-misalignment detection patterns for detecting a position misalignment between images formed by the image forming units are superimposed on one another onto one of the recording medium and the conveying unit, and the detecting unit detects a boundary of the position-misalignment detection patterns, so that at least one of the image forming units is controlled to correct the position misalignment based on the information detected by the detecting unit.

Furthermore, Japanese Patent No. 3266849 discloses another image forming apparatus having a function of correcting the color misalignment. Specifically, the image forming apparatus includes a plurality of photosensitive elements, an optical writing unit that writes different color data of an image on each of the photosensitive elements, and a developing unit that develops the data using corresponding color developer, and configured to form a full color image by sequentially transferring the developed images on the photosensitive elements to the transfer sheet conveyed by a transfer belt. At this state, the image forming apparatus further includes a pattern-image forming unit and a position-misalignment detecting unit. The pattern-image forming unit forms, on one of the transfer belt and a transfer sheet conveyed by the transfer belt, a measurement pattern image for each color that contains lines arranged in close vicinity of each other in the main-scanning direction. The position-misalignment detecting unit includes a slit plate and a position detecting unit on a transfer path corresponding to a position of conveyance of the measurement pattern image. The slit plate is integrated with slits of the same number as that of the lines in the measurement pattern image and with a width substantially equal to a line width. The position detecting unit includes an irradiation light source and detects the amounts of a transmitted light and a reflected light at the measurement pattern image on a slit portion for each slit. With this configuration, a space between the lines in the measurement pattern image is set so that each phase is shifted with respect to a space between slits in the slit plate.

Moreover, Japanese Patent No. 3518825 discloses still another image forming apparatus having the function of correcting the color misalignment. Specifically, the image forming apparatus includes a movable member, a plurality of image carriers, a correction-mark forming unit, a correction-value calculating unit, and a correcting unit. The movable member is conveyed at a predetermined speed and to which a recording sheet is adhered. The image carriers arranged along a conveyance direction of the recording sheet form latent images corresponding to image data by optical scanning of corresponding photosensitive drums, develop the latent images by different developing units, and transfer developed images onto the recording sheet on the movable member. The correction-mark forming unit transfers, on the movable member by using the image carriers, a mixed-color mark in which a plurality of marks are superimposed as a mark for correcting the color misalignment between different color images. The correction-value calculating unit detects a lightness pattern of the mixed mark transferred onto the movable member, and calculates a correction value of the color misalignment between different color images based on the phase of the lightness pattern. The correcting unit corrects the position misalignment between different color images based on the correction value.

However, in the conventional technologies described above, the amount of the color misalignment is measured based on the output from a sensor that reads the color-misalignment detection pattern formed on an image forming surface of the image carries that moves at a predetermined speed in the sub-scanning direction. Therefore, if the total length of the color-misalignment detection pattern increases, a detection time also increases, resulting in increasing a total processing time for measuring the amount of the color misalignment.

SUMMARY OF THE INVENTION

It is an object of the present invention to at least partially solve the problems in the conventional technology.

According to an aspect of the present invention, there is provided an image forming apparatus including a pattern forming unit that forms a color-misalignment detection pattern on an image carrier; a light-intensity detecting unit that detects the color-misalignment detection pattern formed on the image carrier by irradiating the image carrier with a light and detecting light intensity of a reflected light from the image carrier; and a color-misalignment-amount detecting unit that detects an amount of a color misalignment of an image based on the light intensity of the reflected light detected by the light-intensity detecting unit. A spot of the light on the image carrier is elongated in a main-scanning direction.

Furthermore, according to another aspect of the present invention, there is provided an image forming method including forming a color-misalignment detection pattern on an image carrier; detecting the color-misalignment detection pattern formed on the image carrier by irradiating the image carrier with a light and detecting light intensity of a reflected light from the image carrier; and detecting an amount of a color misalignment of an image based on the light intensity of the reflected light. A spot of the light on the image carrier is elongated in a main-scanning direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
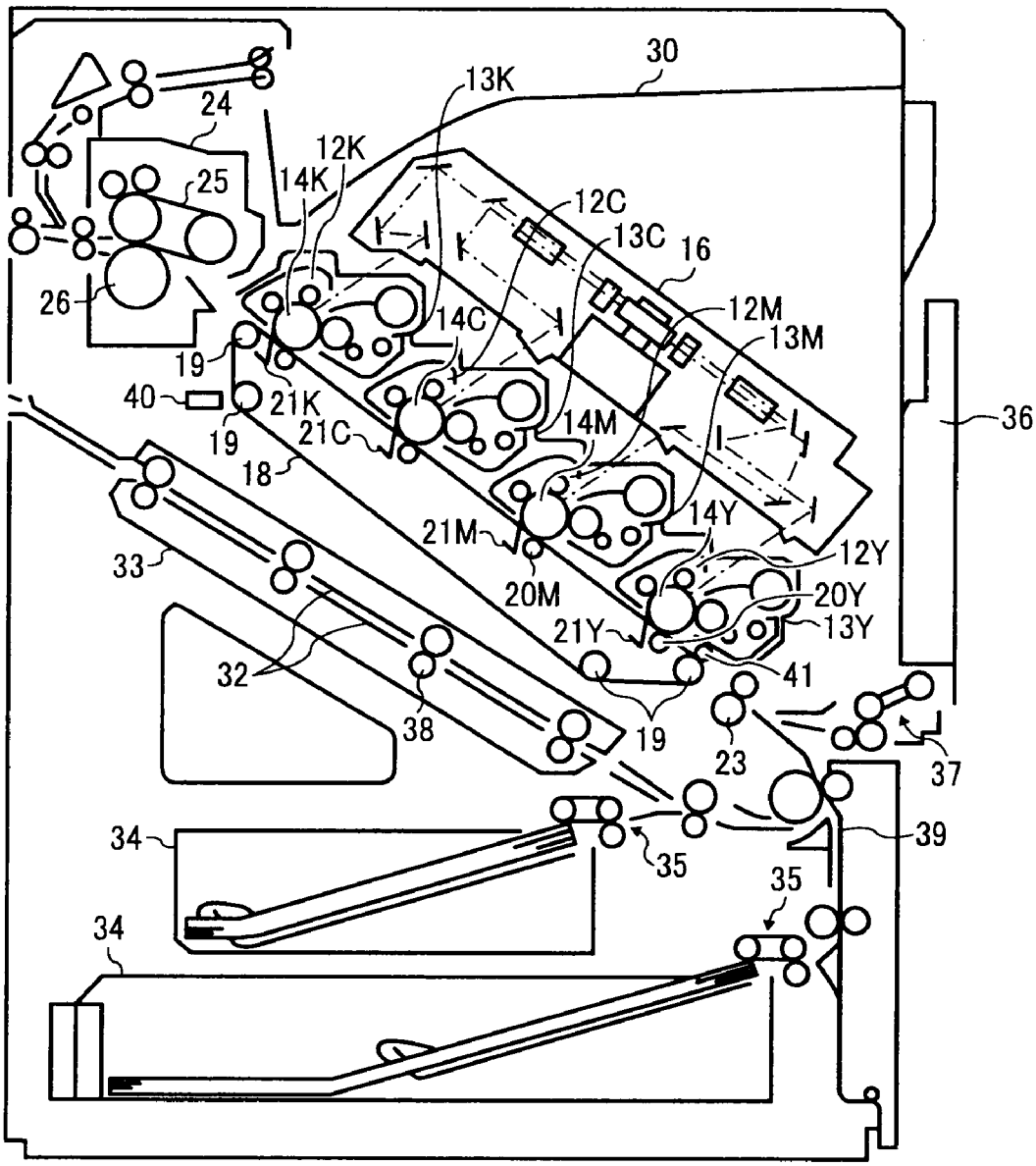
FIG. 1 is a schematic diagram of a color image forming apparatus according to an embodiment of the present invention.

FIG. 1 is a schematic diagram of a color image forming apparatus according to an embodiment of the present invention. The color image forming apparatus includes a bypass tray 36 and two feed cassettes (a first feed cassette and a second feed cassette) 34. A transfer sheet fed from the bypass tray 36 is directly conveyed to a registration roller 23 by a feed roller 37. A transfer sheet fed from the feed cassette 34 (either one of the first feed cassette and the second feed cassette) is conveyed to an intermediate roller 39 by a feed roller 35 and then conveyed from the intermediate roller 39 to the registration roller 23. The transfer sheet is then conveyed to a transfer belt 18 by turning ON a registration clutch (not shown) at substantially the same timing at which a leading edge of an image formed on a photosensitive element matches a leading edge of the transfer sheet. When the transfer sheet passes through an adhesive nip formed of the transfer belt 18 and an adhering roller 41 in contact with the transfer belt 18, the transfer sheet adheres to the transfer belt 18 due to bias voltage applied to the adhering roller 41 thereby being conveyed at a predetermined process line speed.

Each of transfer brushes 21K, 21C, 21M, and 21Y arranged opposite to each of photosensitive drums 14K, 14C, 14M, and 14Y across the transfer belt 18, applies a transfer bias having a polarity (positive) opposite to a charging polarity of toner (negative) to the transfer sheet adhering to the transfer belt 18. As a result, toner images in yellow (Y), magenta (M), cyan (C), and black (K) formed on the photosensitive drums 14Y, 14M, 14C, and 14K, respectively, are sequentially transferred onto the transfer sheet.

The transfer sheet that has been subjected to the above transfer process is self-stripped from the transfer belt 18 by a drive roller 19 of a transfer-belt unit, and conveyed to a fixing unit 24. The toner image on the transfer sheet is fixed when the transfer sheet passes through a fixing nip formed of a fixing belt 25 and a pressure roller 26. In a single-sided printing mode, the transfer sheet is then discharged to an FD tray 30.

When a double-sided printing mode is selected in advance, the transfer sheet is conveyed to a reversing unit (not shown) from the fixing unit 24. The reversing unit reverses a printing surface of the transfer sheet and conveys it to a duplex feed unit 33 arranged below a transfer unit. The transfer sheet is then conveyed by a conveyance roller 38 from a conveyance path 32 to the registration roller 23 through the intermediate roller 39. The transfer sheet is then subjected to the same printing processing performed in the single-sided printing mode described above, and discharged to the FD tray 30 through the fixing unit 24.

An operation of an imaging unit (image forming unit) of the color image forming apparatus is described below.

The image forming unit includes imaging units 12K, 12C, 12M and 12Y and developing units 13K, 13C, 13M and 13Y. Each of the imaging units 12K, 12C, 12M and 12Y includes a corresponding one of the photosensitive drums 14K, 14C, 14M and 14Y, a charging roller (not shown), and a cleaning unit (not shown). At a time of image forming, the photosensitive drums 14K, 14C, 14M and 14Y are rotated by a main motor (not shown) and neutralized by alternating current (AC) bias (without direct current (DC) component) applied to the charging roller to set the surface potentials of the photosensitive drums 14K, 14C, 14M and 14Y at reference potentials of about −50 volts.

The photosensitive drums 14K, 14C, 14M and 14Y are uniformly charged to a potential substantially equal to the DC component by applying DC bias superimposed with AC bias to the charging roller so that the surface potentials of the photosensitive drums 14K, 14C, 14M and 14Y are set to about −500 volts to −700 volts (a target potential is determined by a process control unit). Image data as a print image sent from a controller (not shown) is converted into a binarized laser-diode (LD) light emission signal for each color. The LD light emission signal passes through a cylindrical lens, a polygon motor, an fθ lens, a first mirror, a second mirror, a third mirror, and a long troidal (WTL) lens (a writing unit 16), and is irradiated onto a corresponding one of the photosensitive drums 14K, 14C, 14M and 14Y. Thus, the surface potentials of irradiated portions of the photosensitive drums 14K, 14C, 14M and 14Y are set to about −50 volts, and an electrostatic latent image corresponding to image data is formed.

Each of the developing units 13K, 13C, 13M and 13Y performs a developing process in which the electrostatic latent image corresponding to each color image data on each of the photosensitive drums 14K, 14C, 14M and 14Y is developed to form a toner image using toners (Q/M: −20 μC/g to −30 μC/g) in image portions where the potential is reduced by LD writing. The Q/M represents a charge amount per unit mass.

The toner images formed on the photosensitive drums 14K, 14C, 14M and 14Y in respective colors are transferred onto the transfer sheet, which is delivered by the registration roller 23 and adhering to the transfer belt 18 after passing through the adhesive nip formed of the transfer belt 18 and the adhering roller 41, by a bias (transfer bias) having a polarity opposite to a charging polarity of the toners and applied to the transfer brushes 21K, 21C, 21M, and 21Y arranged opposite to the respective photosensitive drums 14K, 14C, 14M and 14Y across the transfer belt 18. Reference numeral 40 denotes a sensor that detects a light intensity adjustment pattern to be explained later. Reference numeral 20 denotes rollers that ensure contacts between the transfer belt 18 and each of the photosensitive drums 14K, 14C, 14M and 14Y; however only rollers 20M and 20Y are shown in the drawings. It is noted that the potential values described above are only examples.

Figure 2:
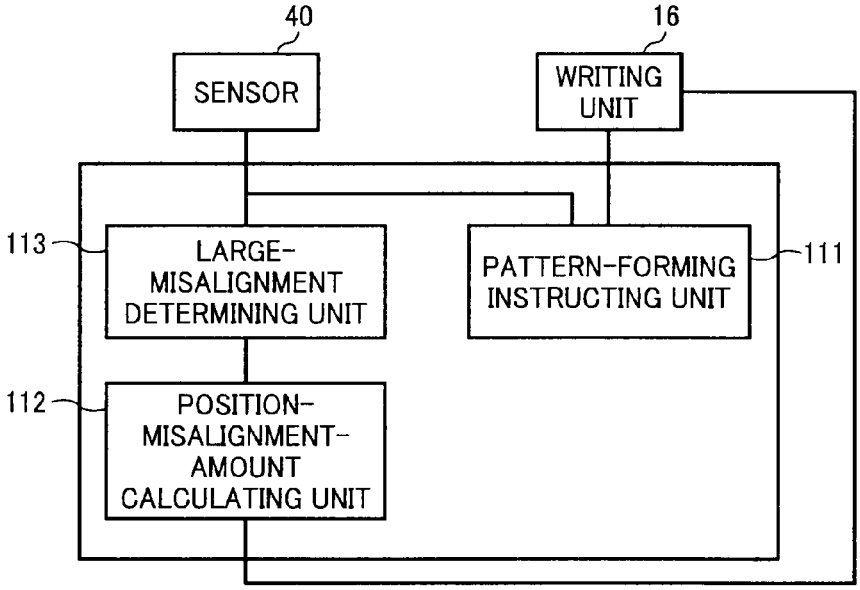
FIG. 2 is a functional block diagram of a control unit for adjusting an amount of position misalignment according to the embodiment.

FIG. 2 is a functional block diagram of a position misalignment adjusting unit for adjusting an amount of a position misalignment according to the embodiment. The position misalignment adjusting unit according to the embodiment includes the sensor 40, the writing unit 16, a pattern-forming instructing unit 111, a large-misalignment determining unit 113, and a position-misalignment-amount calculating unit 112.

The sensor 40 irradiates the position-misalignment detection pattern with a light and receives a reflected light from the position-misalignment detection pattern. Detailed explanations of the sensor 40 will be given later.

The writing unit 16 forms (prints) images and the position-misalignment detection pattern on the transfer belt 18. The pattern-forming instructing unit 111 issues a command for forming the position-misalignment detection pattern to the writing unit 16. The position-misalignment-amount calculating unit 112 calculates the amount of a position misalignment. The large-misalignment determining unit 113 determines that a large position misalignment is present when the amount of the position misalignment is larger than a predetermined value.

Figure 3:
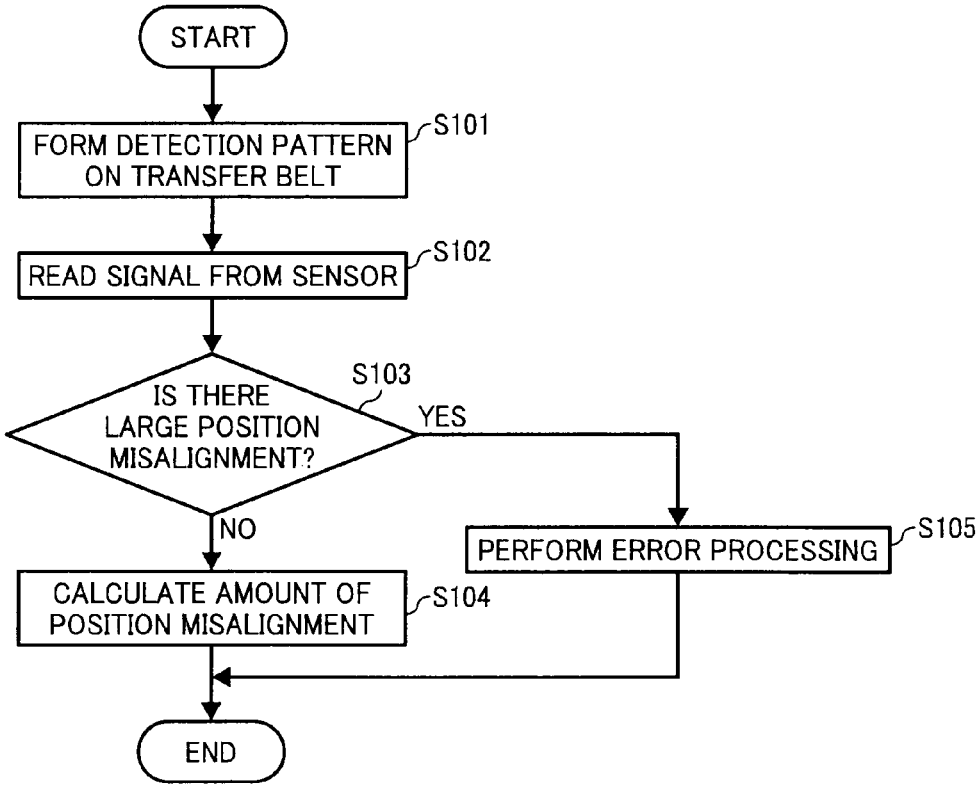
FIG. 3 is a flowchart of a position misalignment adjustment process according to the embodiment.

FIG. 3 is a flowchart of a position misalignment adjustment process according to the embodiment. When performing the position misalignment adjustment process, the pattern-forming instructing unit 111 issues a command for printing the position-misalignment detection pattern to the writing unit 16, and the writing unit 16 prints (forms) the position-misalignment detection pattern on the transfer belt 18 (Step S101). The sensor 40 detects the amount of reflected light from the position-misalignment detection pattern (Step S102). The large-misalignment determining unit 113 determines the level of the amount of position misalignment based on the output of detection from the sensor 40 (Step S103). If the amount of position misalignment is smaller than a predetermined amount (No at Step S103), the position-misalignment-amount calculating unit 112 calculates the amount of the position misalignment (Step S104). If the amount of the position misalignment is larger than the predetermined amount and it is determined that a state where the amount of the position misalignment cannot be calculated, that is, the state where a large position misalignment occurs, is present (Yes at Step S103), error processing is performed (Step S105), and process control ends.

Figure 4:
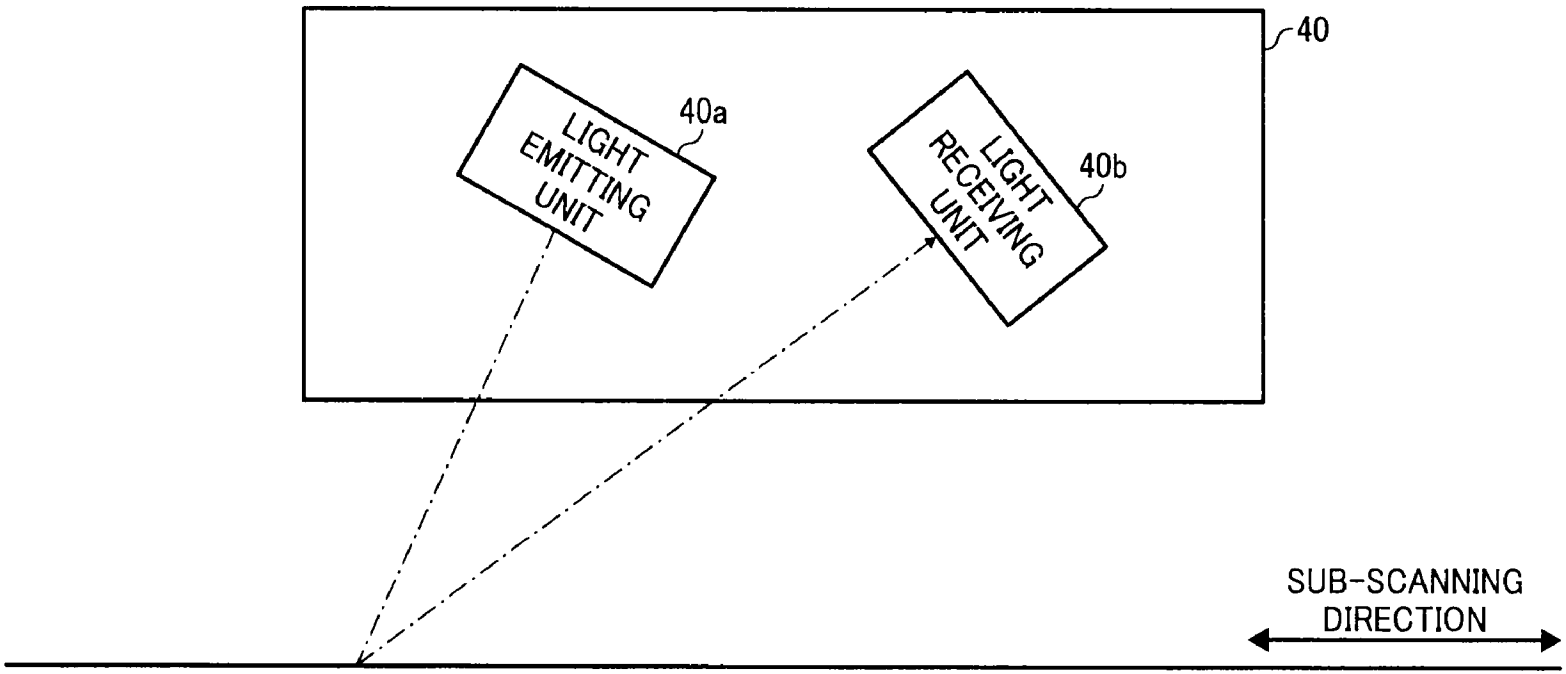
FIG. 4 is a schematic diagram of a sensor shown in FIG. 2.

FIG. 4 is a schematic diagram of the sensor 40. The sensor 40 is a reflection-type sensor and includes a light emitting unit 40*a* and a light receiving unit 40*b*. For example, the light emitting unit 40*a* is a light emitting diode (LED), and the light receiving unit 40*b* is a photodiode that receives a reflected light. According to the embodiment, the light receiving unit 40*b* receives a scattered light as the reflected light.

Figure 5:
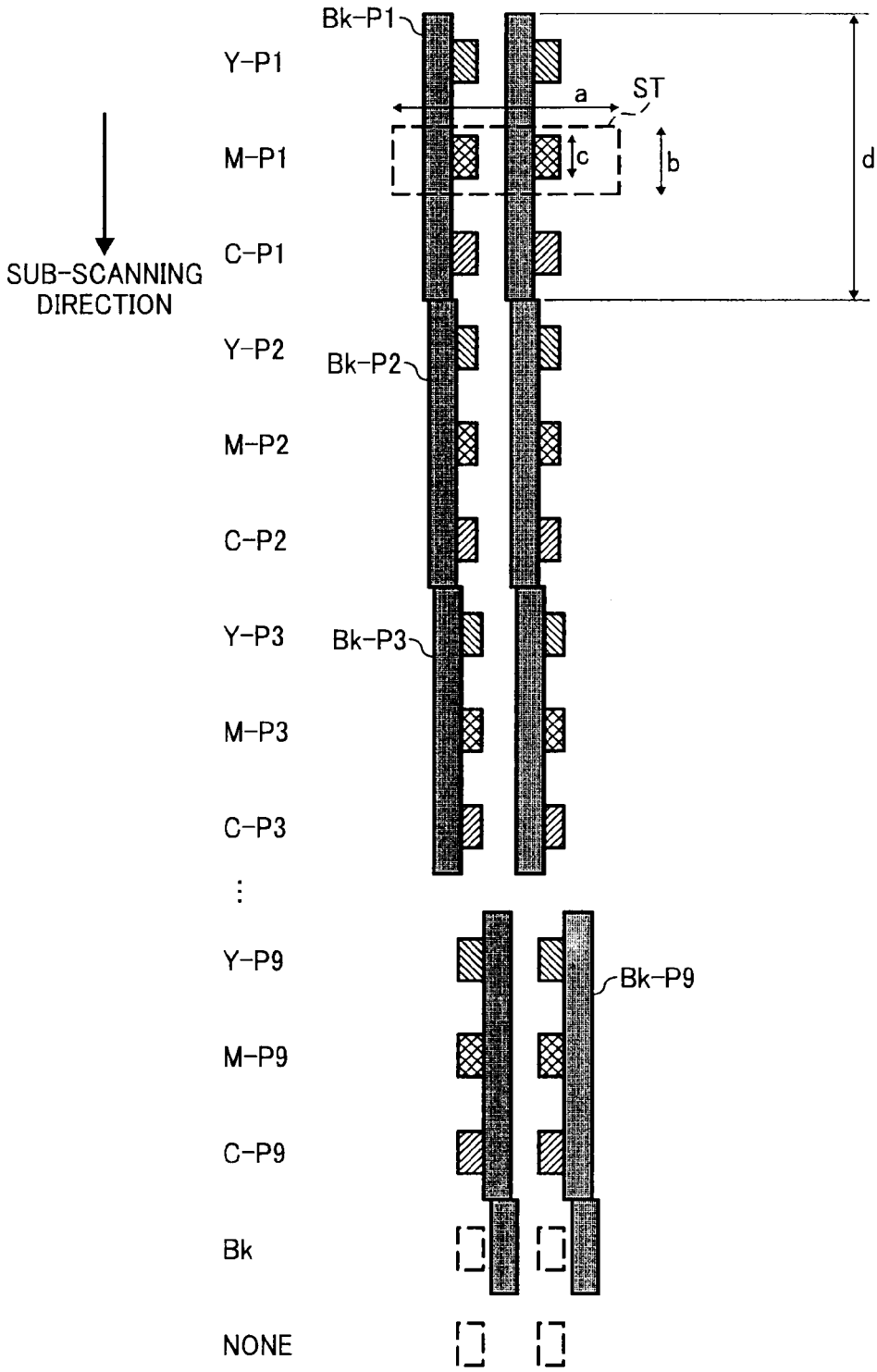
FIG. 5 is a schematic diagram for explaining a relationship between a spot size and each of printed detection patterns for detecting a position misalignment in the main-scanning direction according to the embodiment.

FIG. 5 is a schematic diagram for explaining a relationship between a spot size and each of printed detection patterns for detecting a color misalignment in the main-scanning direction (hereinafter, referred to as "main-scanning color-misalignment detection pattern" as appropriate) according to the embodiment. The main-scanning color-misalignment detection pattern contains three patterns Y-Pn, M-Pn, and C-Pn (n is a positive integer equal to or larger than one) for corresponding colors Y, M, and C arranged along the sub-scanning direction and a pattern Bk-Pn (n is a positive integer equal to or larger than one) for K arranged along with the patterns Y-Pn, M-Pn, and C-Pn. A pattern group containing the patterns Y-Pn, M-Pn, and C-Pn along with the pattern Bk-Pn is arranged in two rows in the main-scanning direction within a main-scanning-direction length of a sensor spot ST. A plurality of the patterns Y-Pn, M-Pn, and C-Pn are aligned along a line corresponding to the sub-scanning direction, while a plurality of the patterns Bk-Pn are arranged in such a manner that the pattern Bk-Pn is shifted from an adjacent pattern Bk-Pn by a predetermined width (predetermined dots) in the main-scanning direction. With this arrangement, a position where the patterns Y-Pn, M-Pn, and C-Pn overlap with the pattern Bk-Pn can be found, and that position corresponds to a position where a position misalignment in the main-scanning direction does not occur. In the example shown in FIG. 5, pattern groups containing the patterns Y-Pn, M-Pn, C-Pn, and Bk-Pn are omitted between groups indicated by P3 and P9. It is assumed that the omitted pattern groups are arranged so that each of the pattern groups is shifted from an adjacent pattern group by a width corresponding to the amount of a position misalignment between groups indicated by P1 and P2.

As described above, the color-misalignment detection pattern is formed in such a manner that the pattern Bk-P for a reference color K is overlapped with the patterns Y-P, M-P, and C-P for other colors Y, M, and C in a pattern group, and a plurality of the pattern groups are arranged along the sub-scanning direction with a predetermined shift in the main-scanning direction between adjacent pattern groups. With this arrangement, the amount of position misalignment in the main-scanning direction is measured based on a variation of the output from the sensor 40 caused by a position misalignment in the main-scanning direction between the pattern Bk-P of the reference color K and the patterns Y-P, M-P, and C-P for other colors Y, M, and C.

At this state, a sub-scanning-direction length c of a rectangle of the main-scanning color-misalignment detection pattern for other colors (other pattern) is set to be shorter than a sub-scanning-direction length b of the sensor spot ST. Furthermore, a sub-scanning-direction length d of the pattern Bk-P for the reference color K (reference pattern) is set to be longer than the sub-scanning-direction length b of the sensor spot ST.

That is, each of the main-scanning color-misalignment detection patterns shifted from an adjacent pattern satisfies the below condition (sub-scanning-direction length b of the sensor spot ST)>(sub-scanning-direction length c of the other pattern)

(sub-scanning-direction length d of the reference pattern)>(sub-scanning-direction length b of the sensor spot ST)

and the same patterns are arranged in the main-scanning direction. Accordingly, it is possible to obtain data on the color misalignment from a region with a sub-scanning-direction length shorter than a main-scanning-direction length in the pattern. Therefore, the total length of the patterns in the sub-scanning direction is reduced, thus reducing a time for measuring the amount of the color misalignment. Furthermore, an obtainable amount of data on the color misalignment is not reduced because the length in the main-scanning direction has a substantial length. Thus, the precision of detection of the color misalignment can be maintained at a desired level or even improved even the total length of the patterns in the sub-scanning direction is reduced.

According to the embodiment, the sensor spot ST of the sensor 40 is formed with the below condition (main-scanning-direction length a of the sensor spot ST)>(sub-scanning-direction length b of the sensor spot ST)

More specifically, a ratio between the main-scanning-direction length a and the sub-scanning-direction length b is set by (main-scanning-direction length a of the sensor spot ST)>2×(sub-scanning-direction length b of the sensor spot ST)

As a result, it is ensured that data on the color misalignment can be obtained from a region with the sub-scanning-direction length shorter than the main-scanning-direction length.

Figure 7:
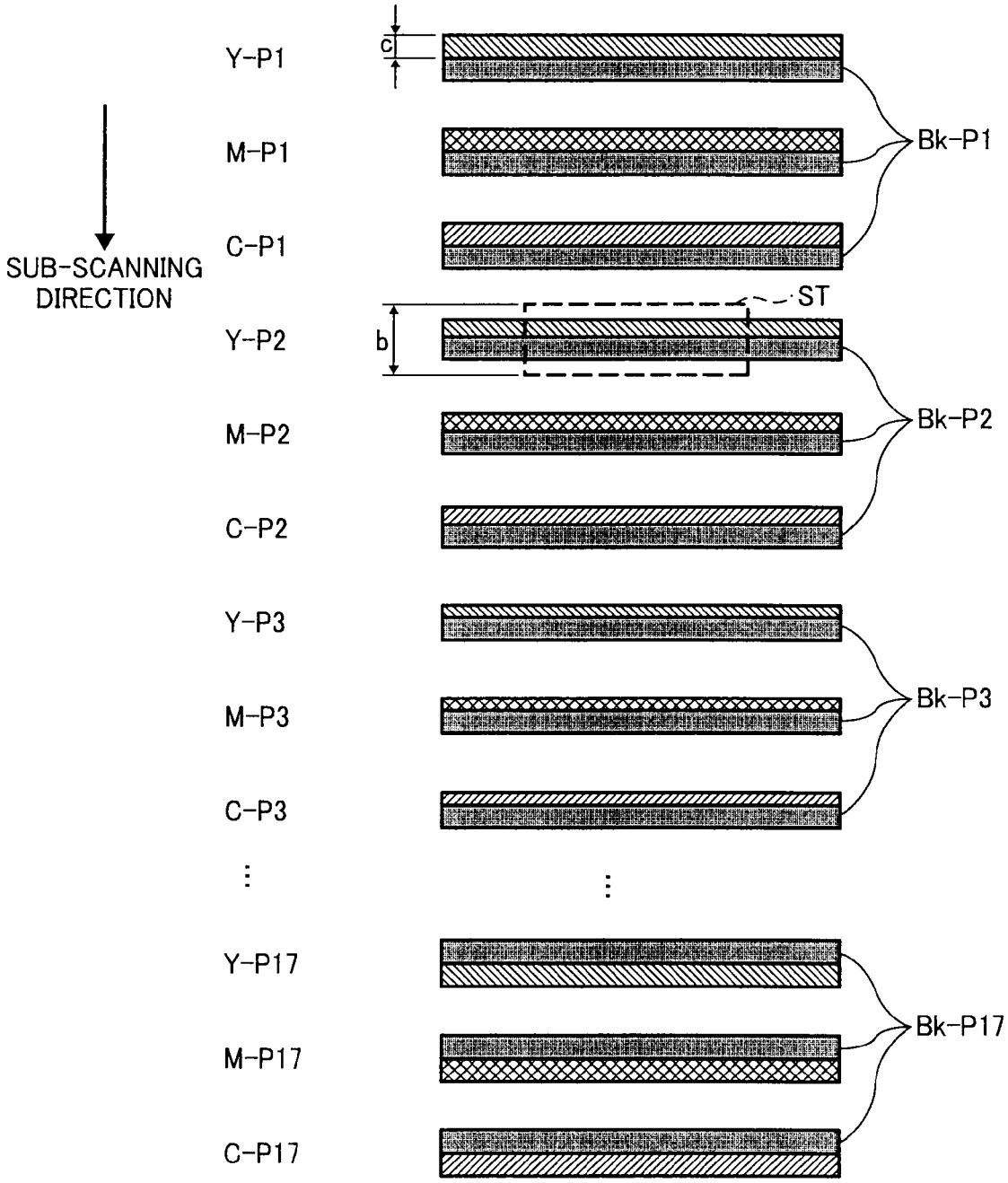
FIG. 7 is a schematic diagram of an example of printed patterns for detecting a position misalignment in the sub-scanning direction according to the embodiment.

FIG. 7 is a schematic diagram of an example of patterns for detecting the color misalignment in the sub-scanning direction (hereinafter, referred to as "sub-scanning color-misalignment detection pattern" as appropriate) according to the embodiment. The sub-scanning color-misalignment detection pattern contains patterns Y-Pn, M-Pn, C-Pn, and Bk-Pn (n is a positive integer equal to or larger than one) for corresponding colors Y, M, C, and K. Each of the patterns Y-Pn, M-Pn, and C-Pn has a predetermined main-scanning width wider than a detection width (main-scanning-direction length of the sensor spot ST) of the sensor 40 and there are spaced from one another by a predetermined interval in the sub-scanning direction. The pattern Bk-Pn is arranged along with each of the patterns Y-Pn, M-Pn, and C-Pn with a predetermined width slightly narrower than that between each of the patterns Y-Pn, M-Pn, and C-Pn. In the example shown in FIG. 7, the pattern Bk-P1 for black is arranged along with each of the patterns Y-P1 for yellow, M-P1 for magenta, and C-P1 for cyan in the sub-scanning direction. That is, the pattern Bk-Pn and each of the patterns Y-Pn, M-Pn, and C-Pn are sequentially arranged in an alternate manner with a space narrower than that between each of the patterns Y-Pn, M-Pn, and C-Pn. Therefore, the pattern Bk-Pn overlaps with one of the patterns Y-Pn, M-Pn, and C-Pn at a certain position to be detected. A detected position corresponds to a position where the color misalignment in the sub-scanning direction does not occur. Thus, the color misalignment (position misalignment) in the sub-scanning direction can be detected based on the output of detected light intensity.

As shown in FIG. 7, the sensor spot ST is set by (pattern width c)<(sub-scanning-direction length b of the sensor spot ST)

Therefore, by detecting (reading) the patterns by a sensor having the sensor spot ST in the above shape, the same effects as those with the main-scanning color-misalignment detection pattern described above can be attained.

Figure 8:
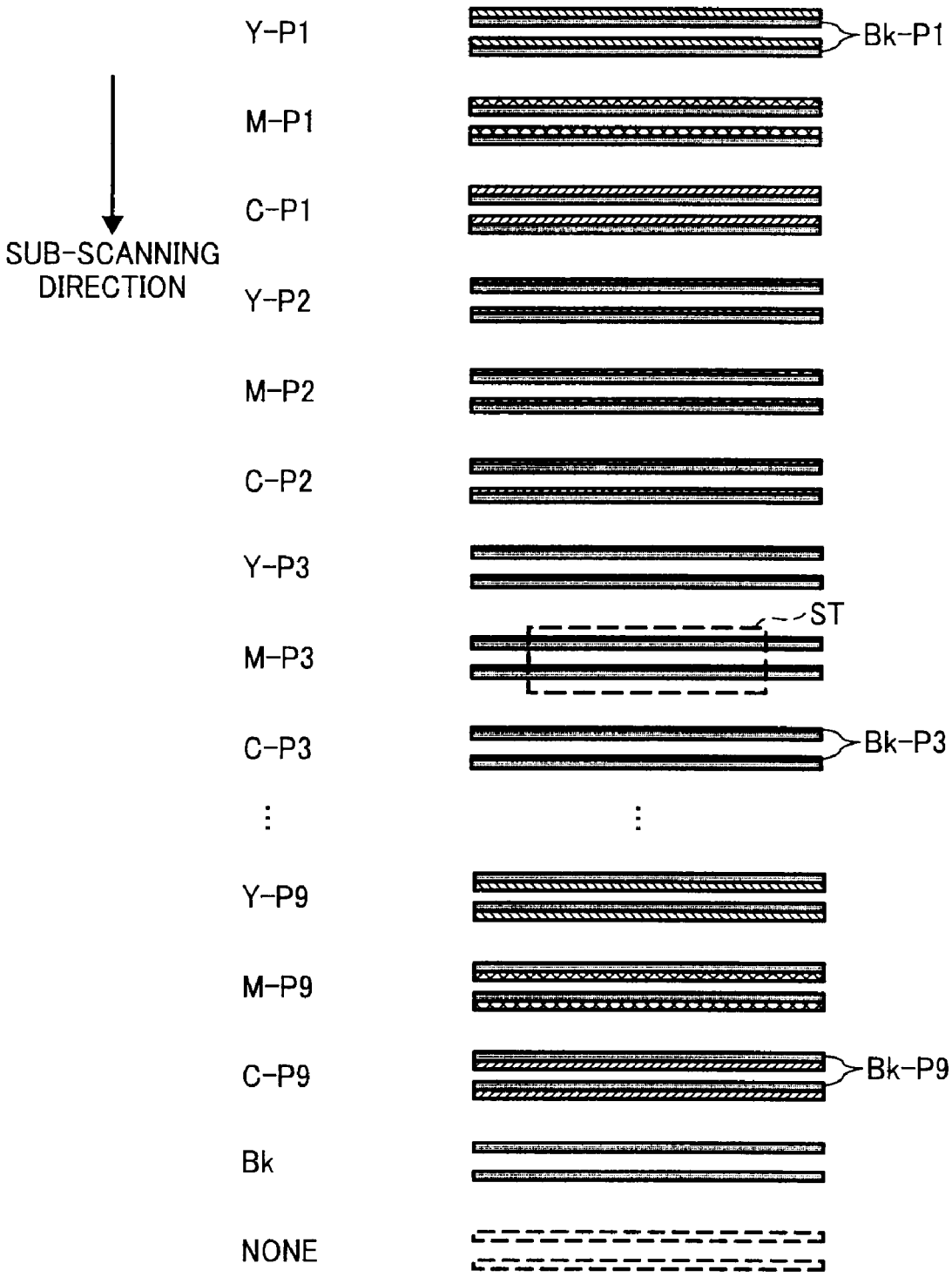
FIG. 8 is a schematic diagram of another example of the printed patterns for detecting a position misalignment in the sub-scanning direction shown in FIG. 7.

If a large position misalignment occurs in patterns shown in FIG. 5, where the same patterns are arranged in the main-scanning direction in a single main-scanning color misalignment detection patch, or patterns shown in FIG. 8, where the same patterns are arranged in the sub-scanning direction in a single sub-scanning color misalignment detection patch, the reference pattern overlaps with the other patterns at a certain position. Therefore, if the amount of the color misalignment is measured by obtaining a minimum point of the output from the sensor 40, it is difficult to distinguish the minimum point obtained from the patterns with the large position misalignment from a normal minimum point obtained from the patterns without the large position misalignment. As a result, the amount of the color misalignment cannot be accurately measured.

Figure 9:
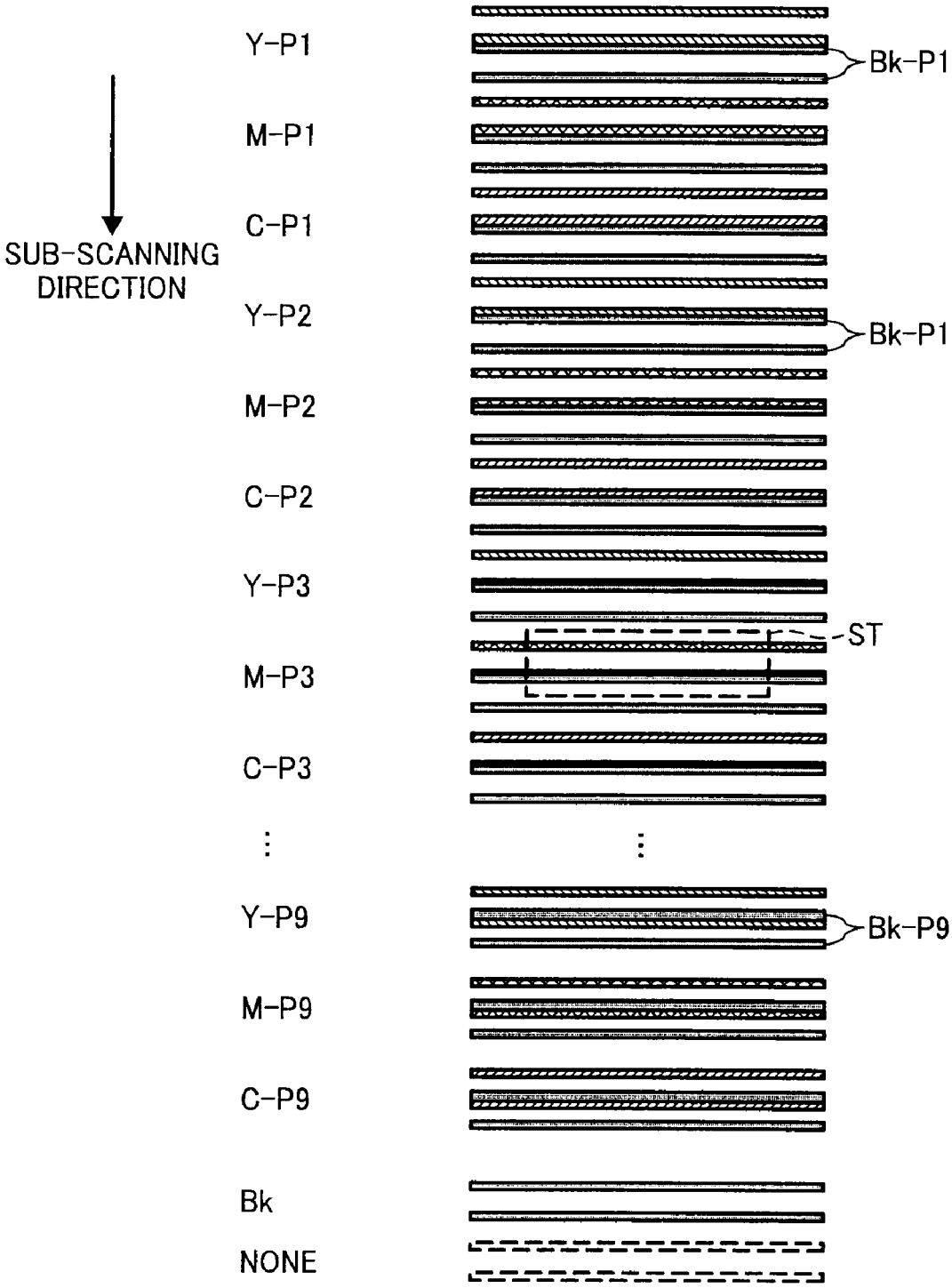
FIG. 9 is a schematic diagram of a state where the patterns shown in FIG. 8 are largely misaligned.

According to the embodiment, there is provided a pattern for measuring a sensor output when only the reference patterns, that is, patterns with reference codes Bk in FIGS. 5, 8, and 9, are present. It is also possible to arrange a region for indicating "none" instead of Bk at the bottom of the patterns shown in FIGS. 5 and 9 to detect the sensor output when the patterns are not arranged.

Figure 6:
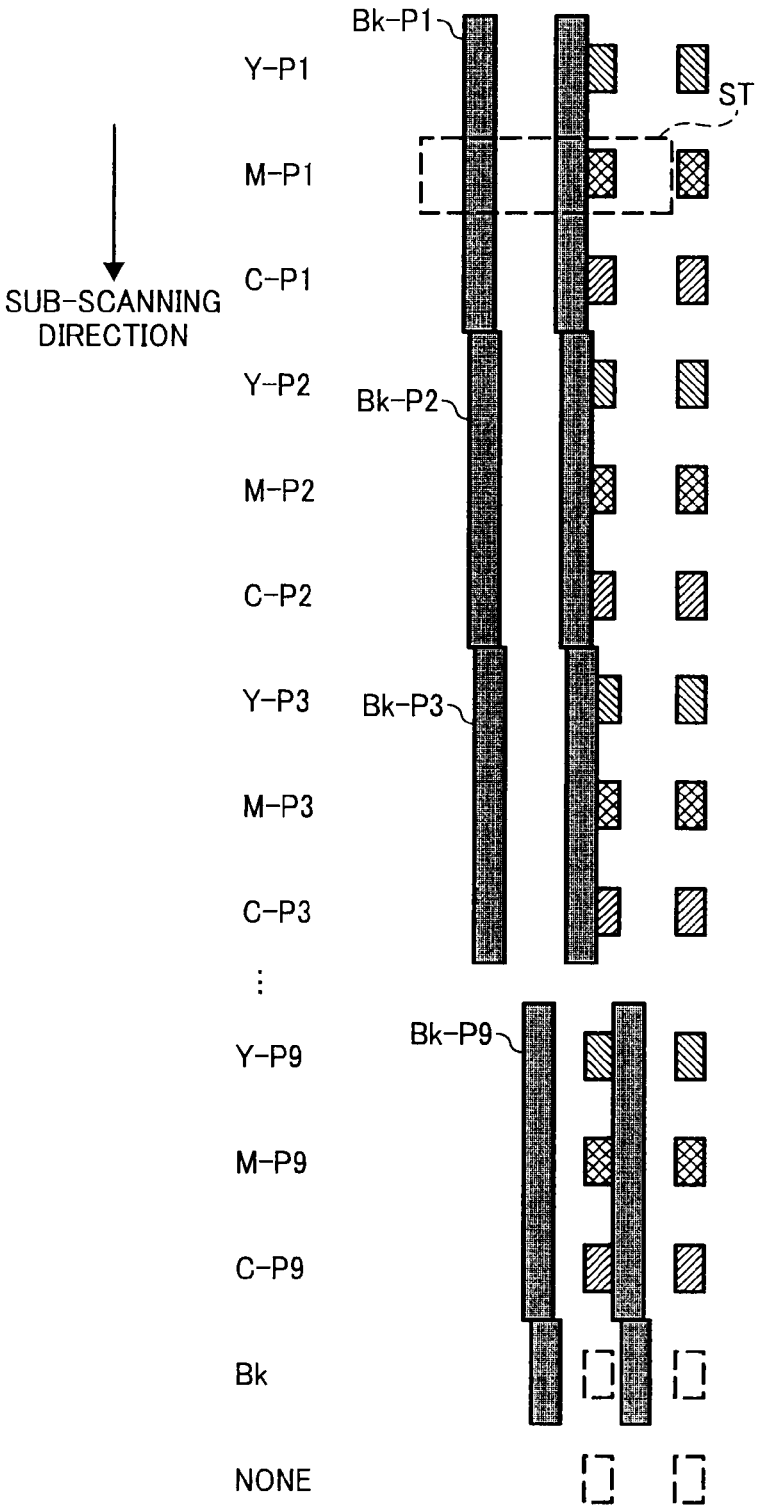
FIG. 6 is a schematic diagram of a state where the patterns shown in FIG. 5 is largely misaligned.
Figure 10:
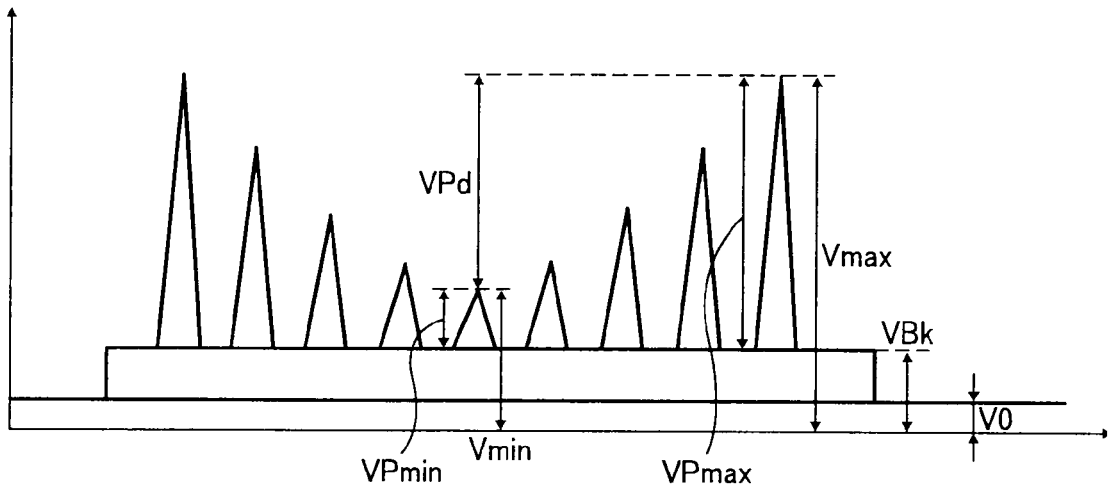
FIG. 10 is a graph of a sensor outputs of the patterns shown in FIG. 5.
Figure 11:
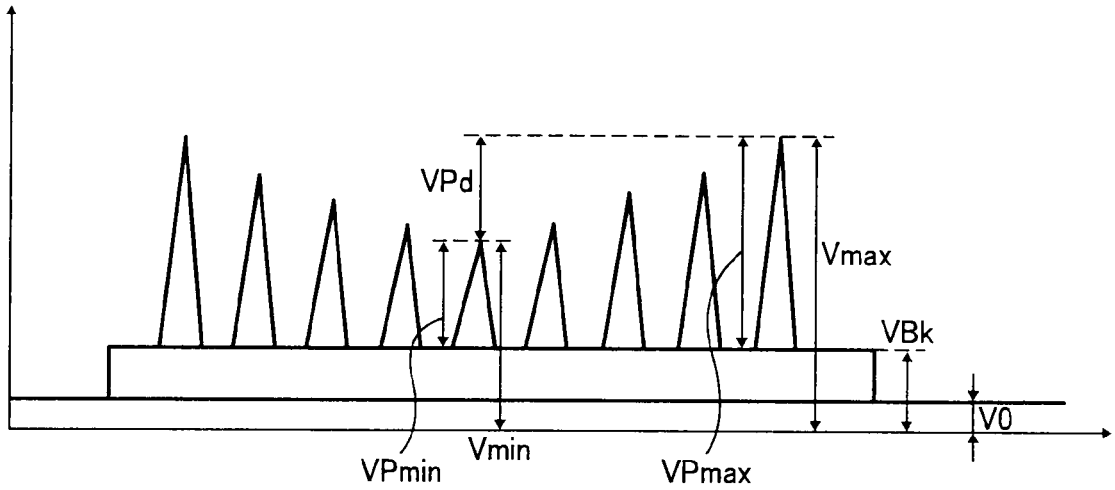
FIG. 11 is a graph of a sensor output of largely misaligned patterns shown in FIG. 6.

FIG. 6 is a schematic diagram of a state where the patterns shown in FIG. 5 are largely misaligned; FIG. 10 is a graph of the sensor output of the patterns shown in FIG. 5; and FIG. 11 is a graph of the sensor output of largely misaligned patterns shown in FIG. 6. In each of the graphs of FIGS. 10 and 11, the sensor output for only one of the other colors (Y, M, C) is shown for a convenience of explanations, and the same sensor outputs of the rest of the other colors to be output in the alternate manner are omitted. The amount of misalignment can be generally obtained by calculating a minimum point of the sensor output based on the characteristics shown in FIG. 10. However, even when the large position misalignment occurs, the minimum point as shown in FIG. 11 is found because the reference pattern overlaps with the adjacent patterns for other colors. Therefore, it is difficult to determine an occurrence of the large position misalignment by calculating the minimum point. On the other hand, when comparing the maximum value and the minimum value shown in FIG. 10 with those shown in FIG. 11, respectively, the maximum output comparatively lowers while the minimum patch comparatively rises due to the large position misalignment. With this characteristics, the occurrence of the large position misalignment can be determined using the following conditions.

Assuming that, in a series of pattern outputs for one of the colors shown in FIG. 10, a maximum pattern level is Vmax, a minimum pattern level is Vmin, a pattern level for only a reference color Bk is VBk, and an output level of a region without the patterns is V0, occurrence of the large position misalignment can be determined by below conditions (1) to (8).

(1) {(Vmax-VBk)/VBk}<(determination value)

(2) {(Vmax-VBk)/(VBk-V0)}<(determination value)

(3) {(Vmax-VBk)/(Vmin-VBk)}<(determination value)

(4) {(Vmin-VBk)/VBk}>(determination value)

(5) {(Vmin-VBk)/(VBk-V0)}>(determination value)

(6) (Vmax-Vmin)<(determination value)

(7) (Vmax-VBk)<(determination value)

(8) When a plurality of the conditions among (1) to (7) are selected in advance, and if at least one of selected conditions is satisfied.

If the above determinations are performed for each of the other colors (Y, M, C), it is possible to determine whether the minimum point caused by the large position misalignment is present for each color.

The determination value is a predetermined value determined based on a result of actual measurement from experiments. The determination value can be changed depending on conditions such as lightness of the transfer belt and reflection condition of the applied light. For example, it is possible to set a determination value such that the determination value decreases as the lightness of the transfer belt decreases.

In the graphs of FIGS. 10 and 11, VPmax indicates the maximum output of the other pattern against the reference pattern, VPmin indicates the minimum output of the other pattern against the reference pattern, and Vpd indicates the difference between the maximum output VPmax and the minimum output VPmin.

FIG. 8 is a schematic diagram of the sub-scanning color-misalignment detection pattern; and FIG. 9 is a schematic diagram of a state where the patterns shown in FIG. 8 are largely misaligned. The large color misalignment in the sub-scanning direction is detected and determined in the same manner as that described in connection with FIGS. 5, 6, 10, and 11, in which a direction of the color misalignment is relatively changed from the main-scanning direction to the sub-scanning direction.

It is also possible to set Vmax by an average value of the maximum pattern output and the second maximum pattern output from among a series of the pattern output for one color. Thus, it is possible to reduce variation in measured values.

As described above, according to the embodiment, the data on the color misalignment for a pattern is obtained from a region with a sub-scanning-direction length shorter than a main-scanning-direction length in relation to the sensor spot ST and the pattern. Therefore, the total length of the pattern in the sub-scanning-direction length is reduced, reducing a time for measuring the amount of a color misalignment. Furthermore, the obtainable amount of data on the color misalignment is not reduced because the main-scanning-direction length has a substantial length. Thus, it is possible to reduce a processing time without degrading the precision of detecting the color misalignment by reducing the total length of the pattern in the sub-scanning direction.

On the other hand, if a large position misalignment in the main-scanning direction occurs and a large position misalignment in the sub-scanning direction occurs, the reference pattern overlaps with the other patterns at a certain position in the main-scanning position-misalignment detection patterns and in the sub-scanning position-misalignment detection patterns, respectively. Therefore, if the amount of the color misalignment is measured by obtaining a minimum point of the output from the sensor, it is difficult to distinguish the minimum point obtained from the patterns with the large position misalignment from a normal minimum point obtained from the patterns without the large position misalignment. As a result, the amount of the color misalignment cannot be accurately measured. At this state, if a measurement process for detecting the large position misalignment is added, the occurrence of the large position misalignment can be detected; however, the total processing time increases.

According to the embodiment, the sensor 40 reads the color-misalignment detection patterns in the main-scanning direction and in the sub-scanning direction, and whether the minimum point is a normal minimum point or obtained from the patterns with the large position misalignment can be determined based on the output result from the sensor 40. Therefore, the occurrence of the large position misalignment can be determined without adding the measurement process for detecting the large position misalignment.

The direct-transfer tandem-type image forming apparatus that forms an image by directly transferring the toner images formed on the photosensitive drums 14Y, 14M, 14C, and 14K onto a recording sheet delivered by the transfer belt 18 is described in the above embodiment. However, the present invention can be applied to an intermediate-transfer tandem-type image forming apparatus that superimposes the toner images on an intermediate transfer belt and transfers a superimposed image onto the recording sheet.

The present invention in its broader aspects is not limited to the specific details and representative embodiments shown and described herein. Accordingly, various modifications can be made without departing from the spirit or scope of the general inventive concept as defined by the appended claims and their equivalents. Furthermore, constituent elements in each embodiment can be omitted as appropriate, or constituent elements over the embodiments can be integrated as appropriate.

As described above, according to an aspect of the present invention, the main-scanning-direction lengths of the spot of the light-intensity detecting unit and the patterns are set longer than their sub-scanning-direction lengths, respectively. Therefore, it is possible to reduce a processing time for detecting and measuring the amount of a color misalignment without decreasing the amount of data necessary for detecting the color misalignment.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a pattern forming unit that forms a color-misalignment detection pattern on an image carrier;

a light-intensity detecting unit that detects the color-misalignment detection pattern formed on the image carrier by irradiating the image carrier with a light and detecting light intensity of a reflected light from the image carrier; and a color-misalignment-amount detecting unit that detects an amount of a color misalignment of an image based on the light intensity of the reflected light detected by the light-intensity detecting unit, wherein:

a spot of the light on the image carrier is elongated in a main-scanning direction, the color-misalignment detection pattern includes a main-scanning-direction misalignment detection pattern for detecting a color misalignment in the main-scanning direction, the pattern forming unit forms the main-scanning-direction misalignment detection pattern including a first pattern for a predetermined reference color and a second pattern for a non-reference color other than the reference color arranged being overlapped with each other on the image carrier, a plurality of the first patterns and a plurality of the second patterns are arranged in the sub-scanning direction with different amounts of the color misalignment in the main-scanning direction, and the light-intensity detecting unit detects the amount of the color misalignment in the main-scanning direction based on a variation in the light intensity caused by shifts of the reflected lights from the first pattern and the second pattern in the main-scanning direction, and a length of the second pattern in the sub-scanning direction is shorter than a length of the spot in the sub-scanning direction.

2. The image forming apparatus according to claim 1, wherein a length of the first pattern in the sub-scanning direction is longer than the length of the spot in the sub-scanning direction.

3. An image forming apparatus comprising:

a pattern forming unit that forms a color-misalignment detection pattern on an image carrier;

a light-intensity detecting unit that detects the color-misalignment detection pattern formed on the image carrier by irradiating the image carrier with a light and detecting light intensity of a reflected light from the image carrier; and a color-misalignment-amount detecting unit that detects an amount of a color misalignment of an image based on the light intensity of the reflected light detected by the light-intensity detecting unit, wherein:

a spot of the light on the image carrier is elongated in a main-scanning direction, the color-misalignment detection pattern includes a main-scanning-direction misalignment detection pattern for detecting a color misalignment in the main-scanning direction or a sub-scanning-direction misalignment detection pattern for detecting a color misalignment in a sub-scanning direction, the pattern forming unit forms one of the main-scanning-direction misalignment detection pattern and the sub-scanning-direction misalignment detection pattern including a first pattern for a predetermined reference color and a second pattern for a non-reference color other than the reference color arranged being overlapped with each other on the image carrier, the first pattern is formed without forming the second pattern in a specific region, and the light-intensity detecting unit detects the amount of the color misalignment in one of the main-scanning direction and the sub-scanning direction based on a variation in the light intensity caused by shifts of the reflected lights from the first pattern and the second pattern in one of the main-scanning direction and the sub-scanning direction, the image forming apparatus further comprising:

a determining unit that determines that there is a large color misalignment in one of the main-scanning direction and the sub-scanning direction when a value obtained by (Vmax-VBk)/VBk is smaller than a preset determination value, where Vmax is a maximum output of one of the main-scanning-direction misalignment detection pattern and the sub-scanning-direction misalignment detection pattern from the light-intensity detecting unit and VBk is an output of the first pattern from the light-intensity detecting unit.

4. The image forming apparatus according to claim 3, wherein a value of Vmax is an average value of the maximum output and a second maximum output from the light-intensity detecting unit.

5. An image forming apparatus comprising:

a pattern forming unit that forms a color-misalignment detection pattern on an image carrier;

a light-intensity detecting unit that detects the color-misalignment detection pattern formed on the image carrier by irradiating the image carrier with a light and detecting light intensity of a reflected light from the image carrier; and a color-misalignment-amount detecting unit that detects an amount of a color misalignment of an image based on the light intensity of the reflected light detected by the light-intensity detecting unit, wherein:

a spot of the light on the image carrier is elongated in a main-scanning direction, the color-misalignment detection pattern includes a main-scanning-direction misalignment detection pattern for detecting a color misalignment in the main-scanning direction or a sub-scanning-direction misalignment detection pattern for detecting a color misalignment in a sub-scanning direction, the pattern forming unit forms one of the main-scanning-direction misalignment detection pattern and the sub-scanning-direction misalignment detection pattern including a first pattern for a predetermined reference color and a second pattern for a non-reference color other than the reference color arranged being overlapped with each other on the image carrier, the first pattern is formed without forming the second pattern in a specific region, and the light-intensity detecting unit detects the amount of the color misalignment in one of the main-scanning direction and the sub-scanning direction based on a variation in the light intensity caused by shifts of the reflected lights from the first pattern and the second pattern in one of the main-scanning direction and the sub-scanning direction, the image forming apparatus further comprising:

a determining unit that determines that there is a large color misalignment in one of the main-scanning direction and the sub-scanning direction when a value obtained by (Vmax-VBk)/(VBk-V0) is smaller than a preset determination value, where Vmax is a maximum output of one of the main-scanning-direction misalignment detection pattern and the sub-scanning-direction misalignment detection pattern from the light-intensity detecting unit, VBk is an output of the first pattern from the light-intensity detecting unit, and V0 is an output without patterns from the light-intensity detecting unit.

6. The image forming apparatus according to claim 5, wherein a value of Vmax is an average value of the maximum output and a second maximum output from the light-intensity detecting unit.

7. An image forming apparatus comprising:

a pattern forming unit that forms a color-misalignment detection pattern on an image carrier;

a light-intensity detecting unit that detects the color-misalignment detection pattern formed on the image carrier by irradiating the image carrier with a light and detecting light intensity of a reflected light from the image carrier; and a color-misalignment-amount detecting unit that detects an amount of a color misalignment of an image based on the light intensity of the reflected light detected by the light-intensity detecting unit, wherein:

a spot of the light on the image carrier is elongated in a main-scanning direction, the color-misalignment detection pattern includes a main-scanning-direction misalignment detection pattern for detecting a color misalignment in the main-scanning direction or a sub-scanning-direction misalignment detection pattern for detecting a color misalignment in a sub-scanning direction, the pattern forming unit forms one of the main-scanning-direction misalignment detection pattern and the sub-scanning-direction misalignment detection pattern including a first pattern for a predetermined reference color and a second pattern for a non-reference color other than the reference color arranged being overlapped with each other on the image carrier, the first pattern is formed without forming the second pattern in a specific region, and the light-intensity detecting unit detects the amount of the color misalignment in one of the main-scanning direction and the sub-scanning direction based on a variation in the light intensity caused by shifts of the reflected lights from the first pattern and the second pattern in one of the main-scanning direction and the sub-scanning direction, the image forming apparatus further comprising:

a determining unit that determines that there is a large color misalignment in one of the main-scanning direction and the sub-scanning direction when a value obtained by (Vmax-VBk)/(Vmin-VBk) is smaller than a preset determination value, where Vmax is a maximum output of one of the main-scanning-direction misalignment detection pattern and the sub-scanning-direction misalignment detection pattern from the light-intensity detecting unit, VBk is an output of the first pattern from the light-intensity detecting unit, and Vmin is a minimum output of one of the main-scanning-direction misalignment detection pattern and the sub-scanning-direction misalignment detection pattern from the light-intensity detecting unit.

8. The image forming apparatus according to claim 7, wherein a value of Vmax is an average value of the maximum output and a second maximum output from the light-intensity detecting unit.

9. An image forming apparatus comprising:

a pattern forming unit that forms a color-misalignment detection pattern on an image carrier;

a light-intensity detecting unit that detects the color-misalignment detection pattern formed on the image carrier by irradiating the image carrier with a light and detecting light intensity of a reflected light from the image carrier; and a color-misalignment-amount detecting unit that detects an amount of a color misalignment of an image based on the light intensity of the reflected light detected by the light-intensity detecting unit, wherein:

a spot of the light on the image carrier is elongated in a main-scanning direction, the color-misalignment detection pattern includes a main-scanning-direction misalignment detection pattern for detecting a color misalignment in the main-scanning direction or a sub-scanning-direction misalignment detection pattern for detecting a color misalignment in a sub-scanning direction, the pattern forming unit forms one of the main-scanning-direction misalignment detection pattern and the sub-scanning-direction misalignment detection pattern including a first pattern for a predetermined reference color and a second pattern for a non-reference color other than the reference color arranged being overlapped with each other on the image carrier, the first pattern is formed without forming the second pattern in a specific region, and the light-intensity detecting unit detects the amount of the color misalignment in one of the main-scanning direction and the sub-scanning direction based on a variation in the light intensity caused by shifts of the reflected lights from the first pattern and the second pattern in one of the main-scanning direction and the sub-scanning direction, the image forming apparatus further comprising:

a determining unit that determines that there is a large color misalignment in one of the main-scanning direction and the sub-scanning direction when a value obtained by (Vmin-VBk)/VBk is larger than a preset determination value, where VBk is an output of the first pattern from the light-intensity detecting unit and Vmin is a minimum output of one of the main-scanning-direction misalignment detection pattern and the sub-scanning-direction misalignment detection pattern from the light-intensity detecting unit.

10. An image forming apparatus comprising:

a pattern forming unit that forms a color-misalignment detection pattern on an image carrier;

a light-intensity detecting unit that detects the color-misalignment detection pattern formed on the image carrier by irradiating the image carrier with a light and detecting light intensity of a reflected light from the image carrier; and a color-misalignment-amount detecting unit that detects an amount of a color misalignment of an image based on the light intensity of the reflected light detected by the light-intensity detecting unit, wherein:

a spot of the light on the image carrier is elongated in a main-scanning direction, the color-misalignment detection pattern includes a main-scanning-direction misalignment detection pattern for detecting a color misalignment in the main-scanning direction or a sub-scanning-direction misalignment detection pattern for detecting a color misalignment in a sub-scanning direction, the pattern forming unit forms one of the main-scanning-direction misalignment detection pattern and the sub-scanning-direction misalignment detection pattern including a first pattern for a predetermined reference color and a second pattern for a non-reference color other than the reference color arranged being overlapped with each other on the image carrier, the first pattern is formed without forming the second pattern in a specific region, and the light-intensity detecting unit detects the amount of the color misalignment in one of the main-scanning direction and the sub-scanning direction based on a variation in the light intensity caused by shifts of the reflected lights from the first pattern and the second pattern in one of the main-scanning direction and the sub-scanning direction, the image forming apparatus further comprising:

a determining unit that determines that there is a large color misalignment in one of the main-scanning direction and the sub-scanning direction when a value obtained by (Vmin-VBk)/(VBk-V0) is larger than a preset determination value, where VBk is an output of the first pattern from the light-intensity detecting unit, Vmin is a minimum output of one of the main-scanning-direction misalignment detection pattern and the sub-scanning-direction misalignment detection pattern from the light-intensity detecting unit, and V0 is an output without patterns from the light-intensity detecting unit.

11. An image forming apparatus comprising:

a pattern forming unit that forms a color-misalignment detection pattern on an image carrier;

a light-intensity detecting unit that detects the color-misalignment detection pattern formed on the image carrier by irradiating the image carrier with a light and detecting light intensity of a reflected light from the image carrier; and a color-misalignment-amount detecting unit that detects an amount of a color misalignment of an image based on the light intensity of the reflected light detected by the light-intensity detecting unit, wherein:

a spot of the light on the image carrier is elongated in a main-scanning direction, the color-misalignment detection pattern includes a main-scanning-direction misalignment detection pattern for detecting a color misalignment in the main-scanning direction or a sub-scanning-direction misalignment detection pattern for detecting a color misalignment in a sub-scanning direction, the pattern forming unit forms one of the main-scanning-direction misalignment detection pattern and the sub-scanning-direction misalignment detection pattern including a first pattern for a predetermined reference color and a second pattern for a non-reference color other than the reference color arranged being overlapped with each other on the image carrier, the first pattern is formed without forming the second pattern in a specific region, and the light-intensity detecting unit detects the amount of the color misalignment in one of the main-scanning direction and the sub-scanning direction based on a variation in the light intensity caused by shifts of the reflected lights from the first pattern and the second pattern in one of the main-scanning direction and the sub-scanning direction, the image forming apparatus further comprising:

a determining unit that determines that there is a large color misalignment in one of the main-scanning direction and the sub-scanning direction when a value obtained by Vmax-Vmin is smaller than a preset determination value, where Vmax is a maximum output of one of the main-scanning-direction misalignment detection pattern and the sub-scanning-direction misalignment detection pattern from the light-intensity detecting unit and Vmin is a minimum output of one of the main-scanning-direction misalignment detection pattern and the sub-scanning-direction misalignment detection pattern from the light-intensity detecting unit.

12. The image forming apparatus according to claim 11, wherein a value of Vmax is an average value of the maximum output and a second maximum output from the light-intensity detecting unit.

13. An image forming apparatus comprising:

a pattern forming unit that forms a color-misalignment detection pattern on an image carrier;

a light-intensity detecting unit that detects the color-misalignment detection pattern formed on the image carrier by irradiating the image carrier with a light and detecting light intensity of a reflected light from the image carrier; and a color-misalignment-amount detecting unit that detects an amount of a color misalignment of an image based on the light intensity of the reflected light detected by the light-intensity detecting unit, wherein:

a spot of the light on the image carrier is elongated in a main-scanning direction, the color-misalignment detection pattern includes a main-scanning-direction misalignment detection pattern for detecting a color misalignment in the main-scanning direction or a sub-scanning-direction misalignment detection pattern for detecting a color misalignment in a sub-scanning direction, the pattern forming unit forms one of the main-scanning-direction misalignment detection pattern and the sub-scanning-direction misalignment detection pattern including a first pattern for a predetermined reference color and a second pattern for a non-reference color other than the reference color arranged being overlapped with each other on the image carrier, the first pattern is formed without forming the second pattern in a specific region, and the light-intensity detecting unit detects the amount of the color misalignment in one of the main-scanning direction and the sub-scanning direction based on a variation in the light intensity caused by shifts of the reflected lights from the first pattern and the second pattern in one of the main-scanning direction and the sub-scanning direction, the image forming apparatus further comprising:

a determining unit that determines that there is a large color misalignment in one of the main-scanning direction and the sub-scanning direction when a value obtained by Vmax-VBk is smaller than a preset determination value, where Vmax is a maximum output of one of the main-scanning-direction misalignment detection pattern and the sub-scanning-direction misalignment detection pattern from the light-intensity detecting unit and VBk is an output of the first pattern from the light-intensity detecting unit.

14. The image forming apparatus according to claim 13, wherein a value of Vmax is an average value of the maximum output and a second maximum output from the light-intensity detecting unit.

15. An image forming apparatus comprising:

a pattern forming unit that forms a color-misalignment detection pattern on an image carrier;

a light-intensity detecting unit that detects the color-misalignment detection pattern formed on the image carrier by irradiating the image carrier with a light and detecting light intensity of a reflected light from the image carrier; and a color-misalignment-amount detecting unit that detects an amount of a color misalignment of an image based on the light intensity of the reflected light detected by the light-intensity detecting unit, wherein:

a spot of the light on the image carrier is elongated in a main-scanning direction, the color-misalignment detection pattern includes a main-scanning-direction misalignment detection pattern for detecting a color misalignment in the main-scanning direction or a sub-scanning-direction misalignment detection pattern for detecting a color misalignment in a sub-scanning direction, the pattern forming unit forms one of the main-scanning-direction misalignment detection pattern and the sub-scanning-direction misalignment detection pattern including a first pattern for a predetermined reference color and a second pattern for a non-reference color other than the reference color arranged being overlapped with each other on the image carrier, the first pattern is formed without forming the second pattern in a specific region, and the light-intensity detecting unit detects the amount of the color misalignment in one of the main-scanning direction and the sub-scanning direction based on a variation in the light intensity caused by shifts of the reflected lights from the first pattern and the second pattern in one of the main-scanning direction and the sub-scanning direction, the image forming apparatus further comprising:

a storage unit that stores therein a plurality of determination conditions selected from {(Vmax-VBk)/VBk}<(determination value)

{(Vmax-VBk)/(VBk-V0)}<(determination value)

{(Vmax-VBk)/(Vmin-VBk)}<(determination value)

{(Vmin-VBk)/VBk}>(determination value)

{(Vmin-VBk)/(VBk-V0)}>(determination value)

(Vmax-Vmin)<(determination value)

(Vmax-VBk)<(determination value)

where Vmax is a maximum output of one of the main-scanning-direction misalignment detection pattern and the sub-scanning-direction misalignment detection pattern from the light-intensity detecting unit, Vmin is a minimum output of one of the main-scanning-direction misalignment detection pattern and the sub-scanning-direction misalignment detection pattern from the light-intensity detecting unit, VBk is an output of the first pattern from the light-intensity detecting unit, and V0 is an output without patterns from the light-intensity detecting unit; and a determining unit that determines that there is a large color misalignment in one of the main-scanning direction and the sub-scanning direction when any one of values obtained by the determination conditions stored in the storage unit is satisfied.

16. The image forming apparatus according to claim 15, wherein a value of Vmax is an average value of the maximum output and a second maximum output from the light-intensity detecting unit.

* * * * *